US005763105A

United States Patent [19]

Peuker

[11] Patent Number: 5,763,105

[45] Date of Patent: Jun. 9, 1998

[54] SINTERED CONTACT MATERIAL, METHOD FOR PREPARING IT, AND CORRESPONDING CONTACT FACINGS

[75] Inventor: Claudia Peuker, Erlangen, Germany

[73] Assignee: Siemens Aktiengesellschaft, Munich, Germany

[21] Appl. No.: 666,445

[22] PCT Filed: Dec. 22, 1994

[86] PCT No.: PCT/DE94/01527

§ 371 Date: Jun. 21, 1996

§ 102(e) Date: Jun. 21, 1996

[87] PCT Pub. No.: WO95/17759

PCT Pub. Date: Jun. 29, 1995

[30] Foreign Application Priority Data

Dec. 23, 1993 [DE] Germany ..... 43 44 322.2

[51] Int. Cl.[6] ..... B22F 7/00

[52] U.S. Cl. ..... 428/548; 75/247; 419/23; 419/32; 419/56; 252/513; 252/514

[58] Field of Search ..... 75/246, 247; 252/513, 252/514; 419/23, 32, 56; 428/548

[56] References Cited

U.S. PATENT DOCUMENTS

| | | | |
|---|---|---|---|
| 4,609,525 | 9/1986 | Schreiner et al. | 419/6 |
| 5,198,015 | 3/1993 | Tsuji et al. | 75/247 |
| 5,338,505 | 8/1994 | Tsuji et al. | 419/10 |
| 5,422,065 | 6/1995 | Hauner et al. | 420/501 |

FOREIGN PATENT DOCUMENTS

| | | |
|---|---|---|
| 0 462 617 A2 | 1/1991 | European Pat. Off. . |
| 2 511 041 | 2/1983 | France . |

OTHER PUBLICATIONS

Schreiner, H. et al., "The Properties of P/M Electrical Contact Materials", *The International Journal of Powder Metallurgy & Powder Technology*, vol. 12 (1976), pp. 219–228.

Schreiner, H., "Pulvermetallurgie elektrischer Kontakte", Springer–Verlag, Berlin/Göttingen/Heidelberg (1964), pp. 105–140.

*Primary Examiner*—Ngoclan Mai
*Attorney, Agent, or Firm*—Kenyon & Kenyon

[57] ABSTRACT

A sintered contact material comprising silver and nickel is characterized according to the invention in that the mass fraction of nickel is between 5 and 50%, and in that the nickel is present in the silver microstructure with average particle sizes (d+ee ) 1 μm<+e,ovs d<10 μm in largely homogeneous dispersion. A suitable method for preparing said sintered contact material is characterized in that, prior to sintering the nickel is introduced, in the way of mechanical alloying, into the silver microstructure, this operation taking place under an air atmosphere. Contact facings manufactured therefrom can be formed as strips or sections by means of extrusion, as individual contact pieces by means of a shaped part technique, and in each case as a two-layer structure.

20 Claims, 1 Drawing Sheet

SINTERED CONTACT MATERIAL, METHOD FOR PREPARING IT, AND CORRESPONDING CONTACT FACINGS

BACKGROUND OF THE INVENTION

The invention relates to a sintered contact material comprising silver and nickel, to a method for preparing it, and to contact facings made therefrom.

Good utility for switching currents in switchgear of power engineering has been shown in the past by contact materials comprising silver (Ag) and nickel (Ni). The preparation of such contact materials and the manufacture and testing of corresponding contact pieces is described in detail in Int. J. Powder Metallurgy and Powder Technology, Vol. 12 (1976), p. 219–228.

To prepare a contact material comprising silver and nickel, according to the prior art silver powder and nickel powder are customarily wet-mixed in a mixer, dried, pressure-moulded and sintered under a reducing atmosphere. The fineness of the microstructure essentially depends on the size of the starting powders used. Such relationships are described in detail in the monograph by H. Schreiner "Pulvermetallurgie elektrischer Kontakte", [Powder metallurgy of electrical contacts], Springer-Verlag (1976), pages 105 to 140. In particular, an AgNi material prepared by means of precipitated powder and having average grain sizes of 1 μm is specified.

It had previously been assumed that, in the case of contact materials comprising silver and nickel, the nickel particles must be present in the silver in as small and finely dispersed form as possible, in order for the contact to have good switching characteristics. A suitable way of achieving this, in principle, is the known method of mechanical alloying. As early a publication as JP-A 66/33090 discloses a method for preparing materials for electrical contacts on a silver basis, a further component being chosen in the form of a metal which is insoluble or only slightly soluble in silver.

This metal, in particular, is nickel, iron, tungsten or another metal which does not form a mixed crystal with silver or for which, on thermodynamical grounds, according to the state diagram there is the tendency towards segregation.

JP-A 66/33090 aims for a mixed crystal-like constitution of the material. To this end, electrolyte/silver powder and carbonyl-nickel powder are mixed in a ball mill with steel balls under so-called styrene gas for extended periods, for example up to 300 h, in order to obtain a mechanically alloyed powder. The aim is for the powder thus obtained to have grain sizes below 0.01 μm. In an X-ray diffraction analysis, the disappearance of nickel reflections and thus the presence of an amorphous alloy was confirmed in this instance. When contacts are fabricated from an alloy powder thus prepared involving alternate sintering and pressing steps it should be possible for secondary segregations to be formed, but with the grain size of the nickel particles limited to 1 μm.

It was found that when mechanically alloyed silver-nickel powders having the above-described amorphous character are used, undesirable side effects may occur which result in comparatively poor contact characteristics.

SUMMARY OF THE INVENTION

It is an object of the invention to provide an appropriate remedy. A contact material comprising silver and nickel is to be provided which, compared with conventional silver-nickel materials, has improved contact properties. At the same time, the appropriate preparation method and corresponding contact facings are to be described.

The object is achieved, according to the invention, in the case of a sintered contact material comprising silver and nickel, by the mass fraction of nickel being between 5 and 50%, and by the nickel being present in the silver microstructure with average particle sizes 1 μm<$\bar{d}$<10 μm in largely homogeneous dispersion.

Preferably, the average particle size of the nickel is a $\bar{d}$<5 μm, especially $\bar{d}$<3 μm. For the particle size distributions specified, the average distance $\bar{D}$ of the nickel particles should be between 5 and 10 μm.

DETAILED DESCRIPTION OF THE INVENTION

Figure 1:
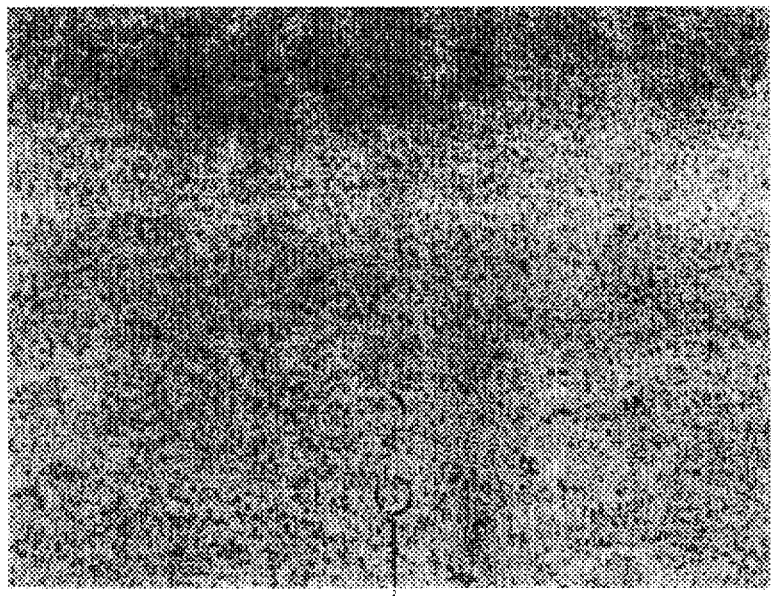
FIG. 1 is a photomicrograph of the material AgNi10 with a detailed view showing the average distance $\bar{D}$ between two nickel particles for particles having a particle size $\bar{d}$ of about 3 μm.

The method for preparing the specified sintered contact material comprising silver and nickel is characterized, according to the invention, in that prior to sintering, the nickel is introduced, in the way of mechanical alloying, into the silver microstructure, this operation taking place under an atmosphere of air. The starting materials used in the process are either silver powder and nickel powder or alternatively a granular material comprising silver and nickel. Preferably, particle size distributions below 500 μm, preferably below 100 μm, especially below 50 μm are possible. Mixing in the way of mechanical alloying takes place in a ball mill and continues until a lamella microstructure has formed, with Ni lamella widths which are very much smaller than the particle diameter of the starting powder. Such a degree of refinement of the microstructure falls within the range of the detection limit of an optical microscope.

The invention makes it possible, employing the silver-nickel powder prepared in the way of mechanical alloying, to employ pressure-moulding such as extrusion or a shaped part technique and sintering under a reducing atmosphere, for contact facings to be fabricated. Preferably, the contact facings are fashioned as strips or sections or as contact pieces and are used in a power engineering switching device.

In contrast to the prior art, the mechanical alloying in the case of the invention is not carried out under a protective gas. Instead, normal atmospheric air is employed. Nor is the mixing, as particularly in JP-A 66/33090, carried out for as long as possible in order to obtain as fine as possible an alloyed powder. Instead deliberate advantage is taken of the operation of mechanical alloying being carried out under air. As a result, oxide skins are formed on the particles which have the same effect as fusion-inhibiting additives. The oxides on the surface of the particles further contribute to embrittlement of the composite particles and thus to more rapid refinement of the microstructure. Compared with mechanial alloying under inert gas, the mechanical alloying operation is considerably shortened.

Further details and advantages of the invention can be gathered from the following description of working examples, reference being made to micrographs with accompanying enlarged detail and a table with the results of an electrical test. Shown in 400 fold magnification are in FIG. 1 the micrograph of a material AgNi10 and in FIG. 2 the micrograph of a material AgNi40.

To prepare the materials AgNi10 and AgNi40, silver powders having a particle size distribution <300 μm and nickel powders having a particle size distribution <150 μm are used as starting materials. After having been weighed in accordingly, the powders are placed into a ball mill (Attritor) and there alloyed mechanically until the nickel in the microstructure being formed has a size of <3 μm and is present homogeneously in the silver. Preparation takes place in the ball mill in an atmosphere of air and without waxes as further additives.

The microstructure refinement produced during mechanical alloying is accompanied by a change in the particle shape and particle size of the powder. Processing under an atmosphere of air deliberately incurs the formation of oxide skins on the particles.

After mixing in the way of mechanical alloying, contact facings are produced in a known manner by pressure-moulding and sintering under a reducing atmosphere. Possible methods of pressure moulding are either extrusion to fabricate strips or sections, or else the so-called shaped part technique for fabricating individual contact pieces. At the same time it is advantageous to produce two-layer contact facings or two-layer contact pieces comprising a first layer of silver-nickel and a second layer of pure silver, in order to ensure a reliable bonding technique to the contact carrier.

Figure 2:
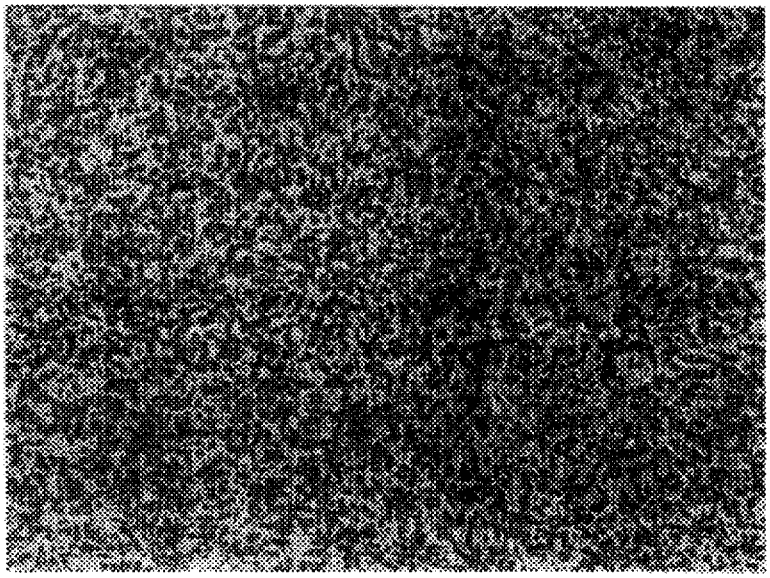
FIG. 2 is a photomicrograph of the material AgNi40.

The micrographs according to FIG. 1 and FIG. 2 show the material AgNi10 on the one hand and AgNi40 on the other hand. This demonstrates the homogeneous dispersion of the nickel particles, whose average particle sizes in FIG. 1 are approximately 3 μm and in FIG. 2 <10 μm throughout. It can be seen from the picture detail relating to FIG. 1, that for nickel particles having a particle size in the order of magnitude of $\bar{d}\approx 3$ μm the average distance $\bar{D}$ of two particles is about twice that, i.e. $\bar{D}=6$ μm. This value $\bar{D}$ likewise is a significant parameter to characterize the material.

The table gives experimental values for welding force Fw, erosion E and the contact resistances Rc during making and breaking. It lists the switching characteristics of the contacts No. 2 and No. 4, produced according to the invention, using as an example the material compositions AgNi10 and AgNi40 which are compared with the characteristics of conventionally produced contacts No. 1 and No. 3 of the same composition.

The electrical test was carried out on convex contacts (r =80 mm) of dimensions 10 mm×10 mm with 1000 making and breaking operations at AC 1000 A, 220 V, cosϕ=0.4 and the contact force 60 N. The bounce time of the first three jumps was 5 ms with a closing rate of 1.0 m/s and an opening rate of 0.8 m/s at a making angle of 0° and a breaking angle of 80°, and a blowout field B=0.5 T/A. The contact resistance test was carried out at 10 A. Erosion was determined by weighing both contact pieces and forming the average. Based on this, and taking into account the theoretical density, the volume erosion was derived.

The table clearly shows that the contact materials No. 2 and No. 4, prepared by methods according to the invention, are distinguished by lower welding force values and by considerably lower erosion rates.

Extensive studies have shown that if mechanically alloyed silver-nickel material is used for switching contacts, a switching microstructure is formed which, compared with conventionally produced materials of the same composition, is richer in nickel, since in the short duration of exposure to the arc the finely dispersed nickel can be dissolved in the melt in greater proportion. When the melt cools, this nickel reprecipitates in finely dispersed form.

The melt which, produced from the silver-nickel material according to the invention, is richer in nickel compared with a previously known AgNi material of the same nickel concentration, has a higher viscosity. As a result, less material is spattered during melting, and contact erosion in the case of the mechanically alloyed material is consequently reduced. Furthermore, with the higher-viscosity melt the gas dissolved in the melt is released in a but lesser proportion, so that during solidification of the material pores are formed to a greater extent in the switching microstructure, which reduce the mechanical strength and thus the welding force.

TABLE

| | | | | Electrical test conditions: 1000 A, 220 V, 1000 n | | | |
|---|---|---|---|---|---|---|---|
| No. | Contact material composition | Example | Ni grain size [μm] | Fw 99.8% welding force [N] | Rc1 99.9% [mOhm] | Rc3 99.9% [mOhm] | Erosion [mm³] |
| 1 | AgNi 90/10 | Comparative example | <40 | 324 | 0.04 | 1.69 | 59.5 |
| 2 | AgNi 90/10 | Working example | <3 | 257 | 0.05 | 2.19 | 38.0 |
| 3 | AgNi 60/40 | Comparative example | <40 | 330 | 0.06 | 3.10 | 14.0 |
| 4 | AgNi 60/40 | Working example | <3 | 194 | 0.05 | 1.50 | 7.7 |

What is claimed is:

1. A sintered contact material comprising silver and from 5 to 50 weight % nickel, wherein the nickel is in a form of nickel particles having an average particle size of between 1 μm and 10 μm, and wherein said nickel particles are homogeneously dispersed in a microstructure of the silver.

2. The sintered contact material according to claim 1, wherein the average particle size of the nickel is less than 5 μm.

3. The sintered contact material according to claim 1, wherein the average particle size of the nickel is less than 3 μm.

4. The sintered contact material according to claim 1, wherein the average distance between the nickel particles is between 5 and 10 μm.

5. The sintered contact material according to claim 1, wherein the nickel particles are produced by a griding process.

6. A method for preparing the sintered contact material of claim 1, comprising the steps of introducing nickel particles into a silver microstructure and subsequently sintering the mixture of silver and nickel.

7. The method according to claim 6, wherein the step of introducing the nickel particles is conducted by mechanical alloying under an air atmosphere.

8. The method according to claim 7, wherein either silver powder and nickel powder or a granular material made of silver and nickel is used in the step of mechanical alloying.

9. The method according to claim 8, wherein the nickel powder or the granular material used has a particle size distribution of less than 500 μm.

10. The method according to claim 8, wherein the nickel powder or the granular material used has a particle size distribution of less than 100 μm.

11. The method according to claim 8, wherein the nickel powder or the granular material used has a particle size distribution of less than 50 μm.

12. The method according to claim 7, wherein the mechanical alloying is conducted in a ball mill and is continued until a lamellar microstructure is formed having nickel lamella having a width which is smaller than the particle diameter of the nickel starting particles.

13. The method according to claim 12, wherein the alloying is continued until the nickel lamella have a width of less than 1 μm.

14. The method according to claim 7, wherein the mechanically alloyed powder is compression-molded and sintered under a reductive atmosphere to produce a contact facing.

15. The method according to claim 14, wherein during sintering nickel lamellae coalesce into globular particles having a particle size distribution of between 1 μm and 10 μm and a particle distance of between 5 and 10 μm.

16. The method according to claim 14, wherein the compression-molding is effected by extrusion.

17. The method according to claim 14, wherein the compression-molding is carried out as a molding technique for contact pieces.

18. A contact facing produced according to the method according to claim 16, wherein said contact facing is fashioned into strips or sections.

19. A contact facing produced according to the method according to claim 17, wherein said contact facing is fashioned into contact pieces.

20. The contact facing according to claim 18, wherein said contact facing is formed as a two-layer structure having a first layer of silver-nickel and a second layer of pure silver.

* * * * *